US006039620A

United States Patent [19]

Itoh et al.

[11] Patent Number: 6,039,620

[45] Date of Patent: Mar. 21, 2000

[54] METHOD OF MANUFACTURING VACUUM HERMETIC VESSELS

[75] Inventors: Shigeo Itoh; Yoshio Makita; Takeshi Tonegawa; Yoshihiko Hirata; Akira Kadowaki, all of Mobara, Japan

[73] Assignee: Futaba Denshi Kogyo K.K., Mobara, Japan

[21] Appl. No.: 08/887,083

[22] Filed: Jul. 2, 1997

[51] Int. Cl.[7] ..... H01J 9/26

[52] U.S. Cl. ..... 445/25

[58] Field of Search ..... 445/25, 3

[56] References Cited

U.S. PATENT DOCUMENTS

| | | | |
|---|---|---|---|
| 3,885,860 | 5/1975 | Sorkin | 350/160 LC |
| 3,931,436 | 1/1976 | Kupsky | 427/96 |
| 4,094,058 | 6/1978 | Yasutake et al. | 29/592 |
| 4,255,848 | 3/1981 | Freer et al. | 29/592 R |
| 5,635,795 | 6/1997 | Itoh et al. | 313/496 |
| 5,820,434 | 10/1998 | Itoh et al. | 445/25 |

*Primary Examiner*—Sandra O'Shea
*Assistant Examiner*—John Anthony Ward
*Attorney, Agent, or Firm*—Oblon, Spivak, McClelland, Maier & Neustadt, P.C.

[57] ABSTRACT

Method for forming a vacuum hermetic vessel. Plural exhaust holes are formed in the first main substrate at a number of positions. A second main substrate is superposed over the first main substrate. The two substrates are hermetically sealed. The two substrates are cut at predetermined positions to form individual vessels. Lead-out electrodes are formed on both the first and second substrates and are not covered by another substrate. The vessels are evacuated and sealed using exhaust tubes.

3 Claims, 4 Drawing Sheets

METHOD OF MANUFACTURING VACUUM HERMETIC VESSELS

BACKGROUND OF THE INVENTION (1) Field of the Invention

This invention relates to a method of manufacturing vacuum hermetic vessels in which vacuum is maintained.

(2) Description of the Related Art

Conventionally, fluorescent display panels are well-known including field emission cathodes referred to as flat cold cathodes as well as anodes coated with fluorescent substance each which collects electrons emitted from the field emission cathode.

In the fluorescent display panel, the cathode and the anode are positioned in parallel so as to leave a small space. To maintain the gap between the cathode and the anode in vacuum, the cathodes and the anodes are contained in a vacuum hermetic vessel.

FIG. 6(*a*) illustrates the configuration of a vacuum hermetic vessel. In the vacuum hermetic vessel 100 shown in FIG. 6(*a*), the first substrate 102 and the second substrate 103 are placed so as to confront each other with a small distance spaced. The first substrate 102 and the second substrate are sealed with a sealing compound (not shown). The first substrate 102 and the second substrate are formed of, for example, glass. A group of flat field emission cathodes are formed on the first substrate 102. Anodes coated with a fluorescent are formed on the second substrate 103. The first substrate 102 and the second substrate 103 are spaced 200 NM to 500 NM and hermetically sealed with a sealing compound.

The first substrate 102 and the second substrate 103 are placed in an elongate direction to confront each other at a position somewhat shifted. As shown in FIG. 6(*a*), the first substrate is larger than the second substrate 103 and its three sides protrude outward from the second substrate 103. A portion of the second substrate 103 protrudes from the remaining side of the first substrate 102. To cover the protruded portion of the second substrate 103, the rectangular getter box 104 internally containing a getter is sealed on the first substrate 102 using a sealing compound. A rectangular communication hole piece 109 with the communication hole 106 formed on the side surface thereof, shown in FIG. 6(*b*), is securely fixed between the protruded portion of the second substrate 103 and the getter box 104. The communication hole piece 109 is further sealed hermetically between the second substrate 103 and the getter box 104 using a sealing compound.

The communication hole 106 formed in the communication hole piece 109 communicates the space containing a display portions formed with the first substrate 102 and the second substrate 103, with the getter box 104.

An exhaust tube 105 is welded on the top surface of the getter box 104. A hole communicating the exhaust tube 105 with the getter box 104 is formed on the top surface of the getter box 104.

The getter box 104 contains a getter. The getter generally is an evaporation type getter including Ba—Al alloy contained in a ring metal member. While the ring member is externally heated by radio-frequency induction, the Ba—Al alloy is heated and evaporated onto the internal wall surface of the getter box 104, thus forming a getter mirror.

In the vacuum hermetic vessel manufacturing method, the first substrate (cathode substrate) 102 on which field emission cathodes are formed and the second substrate (anode substrate) 103 on which anodes coated with fluorescence are prepared. Then, the first substrate 102 is superposed on the second substrate 103. The getter box 104 is placed at a predetermined position. The first substrate 102 and the second substrate 103 are sealed together with the getter box 104. The space (gap) between the first substrate 102 and the substrate 103 is drawn to a vacuum by exhausting the air through the exhaust tube 105. Finally, after the exhaust tube 104 is sealed by welding and then cut, a vacuum hermetic vessel is completely produced.

As described above, according to the conventional vacuum hermetic vessel manufacturing method, after plural field emission cathodes are formed on a single substrate, the single substrate is separated into respective cathode substrates. Similarly, after plural anodes coated with fluorescence are formed on a single substrate, the signal substrate is separated into respective anode substrates. Then vacuum hermetic vessels are respectively fabricated through the above-mentioned manufacturing steps. Hence, the problem is that since plural vacuum hermetic vessels cannot be manufactured in a batch process, the conventional manufacturing method has its limit in the mass production.

SUMMARY OF THE INVENTION

The present invention has been made in view of the foregoing disadvantages of the prior art.

Accordingly, it is the object of the invention is to provide a method of manufacturing vacuum hermetic vessels which can be mass-produced.

In order to accomplish the above-mentioned object, a method of manufacturing a vacuum hermetic vessel is provided by the steps of forming plural exhaust holes in a first main substrate at predetermined positions thereon, the first main substrate from which plural first substrates can be obtained; superposing a second main substrate over the first main substrate with the plural exhaust holes formed therein, the second main substrate from which plural second substrates can be obtained; hermetically sealing the first main substrate and the second main substrate superposed; cutting the first main substrate and the second main substrate hermetically sealed, at predetermined positions, such that lead-out electrodes formed on each of the first substrates and lead-out electrodes formed on each of the second substrates are not covered by another substrates, and then obtaining plural hermetic vessels each formed of a first substrate and a second substrate sealed together at the same time; and evacuating and sealing said plural hermetic vessels cut off respectively, using the exhaust tubes.

Furthermore, according to the present invention, a vacuum vessel manufacturing method is provided by the steps of forming plural exhaust holes in a first main substrate at predetermined positions thereon the first main substrate from which plural first substrates can be obtained; superposing a second main substrate over the first main substrate with the plural exhaust holes formed therein, the second substrate from which plural substrates are obtained, and placing plural getter boxes on the first main substrate so as to cover the exhaust tubes formed therein; hermetically sealing the first main substrate and the second main substrate superposed and, at the same time, hermetically sealing the getter boxes and the first main substrate placed together; evacuating spaces between the first substrates and the second substrates using the plural getter boxes sealed with the first main substrate, and then sealing the first and second substrates; and cutting the first main substrate and the second main substrate evacuated and hermetically sealed, at predetermined positions, while lead-out electrodes formed on each of the first substrates and lead-out electrodes formed on each of the second substrates are not covered by another substrates, whereby plural hermetic vessels each formed of a first substrate and a second substrate evacuated and sealed together are obtained at the same time.

According to the present invention, a vacuum vessel manufacturing method is provided by the steps of forming field emission cathodes to each of the first substrates; and forming anodes on which a fluorescent substance is applied, onto each of the second substrates.

As described above, the present invention enables mass production because plural vacuum hermetic vessels can be fabricated in a batch process.

Moreover, according to the present invention, the vacuum hermetic vessel manufacturing method includes the step of cutting at least the substrates after the sealing step. Hence, the filed emission cathodes or anodes formed on a substrate are not contaminated by particles in the cutting step. This feature can avoid possible risks which may occur in handling the main (multi-piece separable) substrate.

Furthermore, the steps following after the step of superposing main (multi-piece separable) substrates require no clean environments so that the production facility expenses can be reduced.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 6(*b*) is a diagram showing a communication hole piece fabricated according to a conventional vacuum hermetic vessel manufacturing method.

DETAILED DESCRIPTION OF THE PREFERRED EMBODIMENTS

The embodiments according to the present invention will now be described below with reference to the attached drawings.

Figure 1:
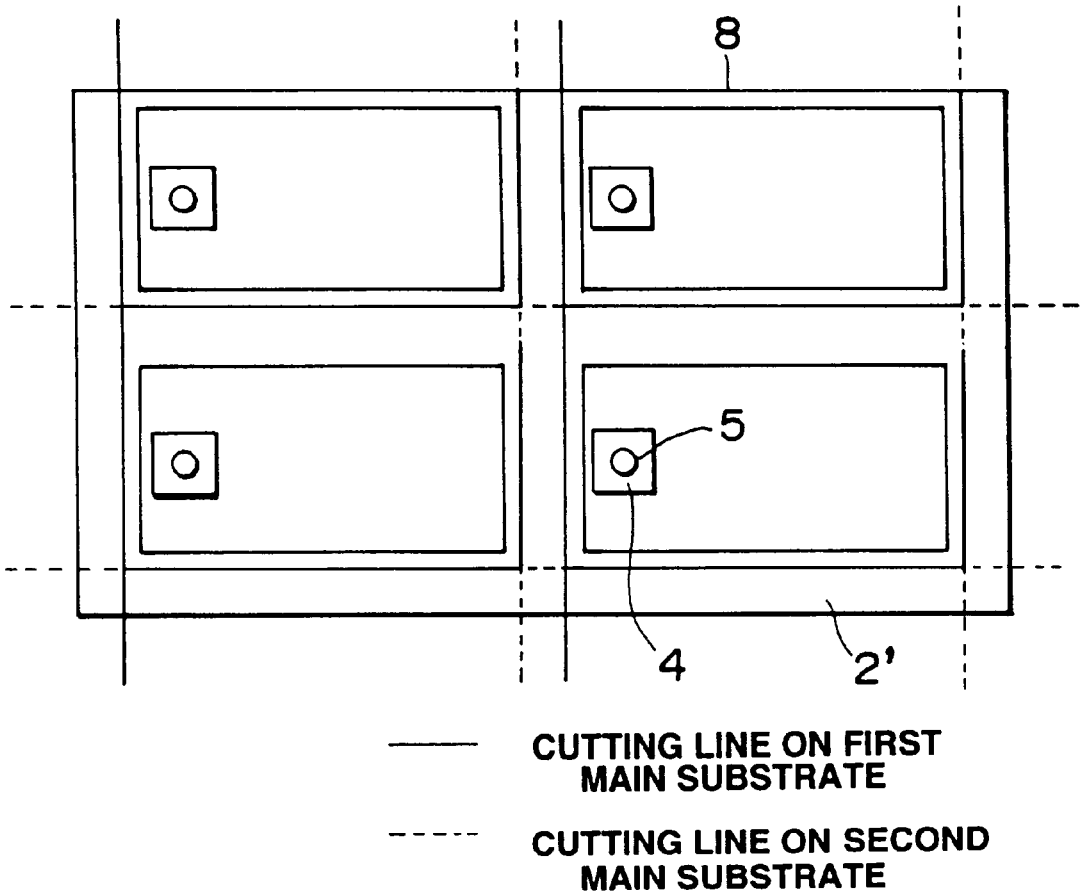
FIG. 1 is a top view partially showing a vacuum hermetic vessel embodying the vacuum hermetic vessel manufacturing method according to the present invention.
Figure 2:
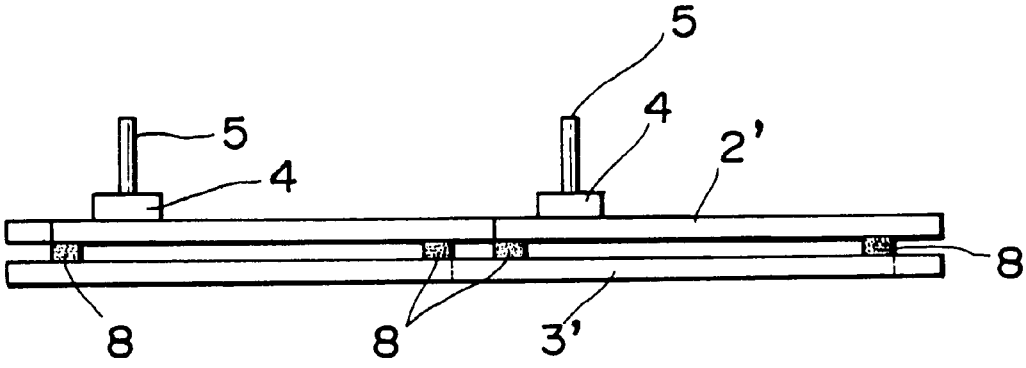
FIG. 2 is a cross-sectional view showing a vacuum hermetic vessel embodying the vacuum hermetic vessel manufacturing method according to the present invention.

FIGS. 1 and 2 illustrate an aspect of a vacuum hermetic vessel of fabricated according to an embodiment of the vacuum hermetic vessel manufacturing method of the present invention. FIG. 1 is a front view illustrating an intermediate structure to prepare four vacuum hermetic vessels in a batch process, according to the manufacturing method. FIG. 2 is a cross-sectional view illustrating the intermediate structure to prepare four vacuum hermetic vessels in a batch process.

Referring to FIGS. 1 and 2, four field emission cathodes are formed on a first multi-piece separable Substrate (hereinafter referred to as a first main substrate) 2' of glass or ceramic from which plural sub-substrates can be obtained. Four anodes coated with fluorescence are formed on a second multi-piece separable substrate (hereinafter referred to as a second main substrate) 3' of transparent glass from which plural substrates are formed.

Four exhaust holes are formed corresponding to the four field emission cathodes formed on the first main substrate 2'. Posts are formed on the first main substrate 2' or the second main substrate 3'. Then, the first main substrate 2' and the second main substrate 3' are aligned to each other and then joined together with a sealing compound 8.

The getter boxes 4 with the exhaust tubes 5 are placed over the exhaust holes formed on the first main substrate 2'. A ring getter is stored within each of the getter boxes 4. A sealing compound 8 is coated to the lower rims of the getter box 4. This intermediate structure is placed into a heating oven to melt the sealing compound 8. Thus, the first main substrate 2' and the second main substrate 3' are hermetically sealed while the first main substrate 2' and the getter boxes 4 are hermetically sealed. This condition is shown in FIGS. 1 and 2.

Next, the intermediate structure of the first main substrate 2' on which four field emission cathodes are formed and the second main substrate 3' on which four anodes are formed is cut into four vacuum hermetic vessels. As shown in FIG. 1, the first main substrate 2' is cut horizontally (top to bottom in FIG. 1) along the two solid lines and vertically (left to right in FIG. 1) along the one solid line. In this cutting step, one end portion of the first main substrate 2' is cut off while the remaining first main substrate 2' is substantially separated into four pieces.

Figure 3:
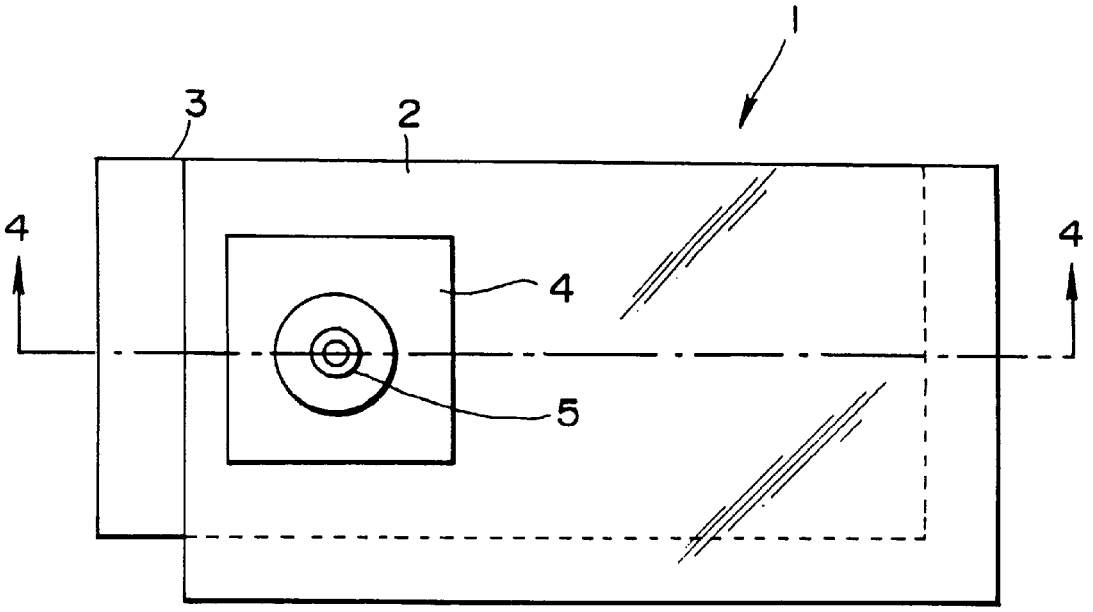
FIG. 3 is a front view showing a configuration of a vacuum hermetic vessel fabricated according to the vacuum hermetic vessel manufacturing method of the present invention.

Four vacuum hermetic vessels 1, as shown in FIG. 3, can be produced at the same time. Each vacuum hermetic vessel 1 is formed of a separate first substrate 2 on which field emission cathodes are formed and a separate second substrate 3 on which anodes coated with fluorescent is formed. The air in each of the vacuum hermetic vessels 1 is evacuated to vacuum through the exhaust tube 5. Thus, a vacuum hermetic vessel 1 forming a display panel is completed by sealing the exhaust tube 5.

The vacuum hermetic vessel 1 shown in FIG. 3 may be fabricated according to the following steps. That is, the first main substrate 2' and the second main substrate are hermetically sealed together while the first main substrate 2' and the getter boxes 4 are hermetically sealed together. Next, after exhaust operation is performed through the four exhaust tubes 5 at the same time, the exhaust tubes are sealed. Then, the intermediate structure is cut out along the solid lines and the broken lines shown in FIG. 1.

In the above explanation, four vacuum hermetic vessels 1 can be obtained in a batch process. However, the manufacturing method according to the present invention should not be limited only to the step of cutting the intermediate structure into four pieces. A larger main substrate may be used to cut out four vacuum hermetic vessels or more at the same time.

Figure 4:
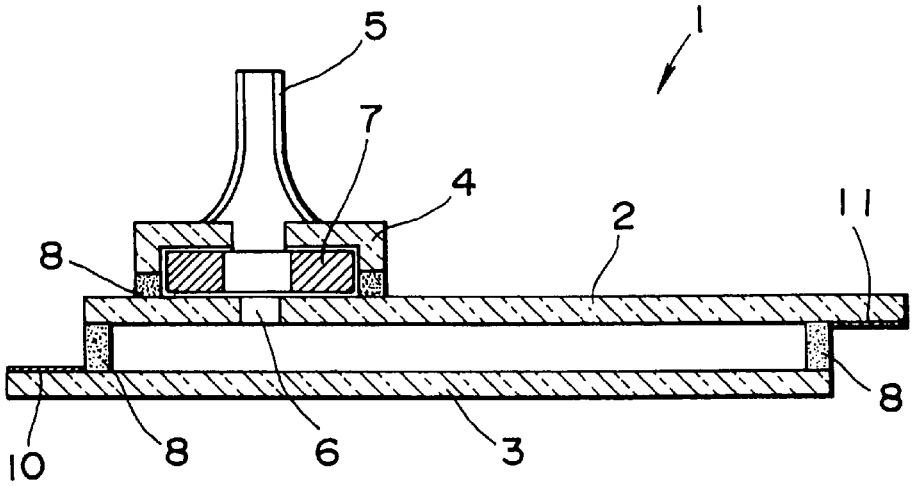
FIG. 4 is a cross-sectional view showing a configuration of a vacuum hermetic vessel fabricated according to the vacuum hermetic vessel manufacturing method of the present invention.

Next, an embodiment of a vacuum hermetic vessel fabricated, according to the vacuum hermetic vessel manufacturing method of the present invention is shown. FIG. 3 is a front view illustrating the vacuum hermetic vessel 1. FIG. 4 is a cross-sectional view illustrating the vacuum hermetic vessel 1 taken along the line A—A shown in FIG. 3.

In FIGS. 3 a nd 4, the first substrate 2 and the second substrate 3 confront each other and are spaced from each other by a small distance. The gap between the first substrate 2 and the second substrate 3 are sealed with the sealing compound 8. The first substrate 2 and the second substrate 3 are formed of, for example, a glass or ceramic substrate. A group of flat field emission cathodes are formed on the first substrate 2. Anodes coated with fluorescence are formed on the second substrate 3. The space or gap between the first substrate 2 and the second substrate 3 ranges, 200 NM to 500 NM.

The first substrate 2 and the second substrate 3 confront each other and are somewhat shifted in an elongate direction. As shown in FIG. 3, since the first substrate 2 is larger than the second substrate 3, the two sides protrude outward from the second substrate 3. A portion of the second substrate 3 protrudes from one of the remaining two sides. As shown In FIG. 4, cathode lead-out electrodes 11, which transmit scanned gate voltage signals, image signals sent to cathodes, and the like, are formed on the protruding area of the first substrate 2. The anode lead-out electrodes 10 transmitting a anode voltage and the like, as shown in FIG. 4, are formed on the protruding area of the second substrate 3.

Furthermore, a rectangular getter box 4 containing a getter is securely adhered on the first substrate 2 using the sealing compound 8. An exhaust hole 6 is formed in the first substrate 2 and the getter box 4.

The exhaust hole 6 communicates the space containing a display portion formed of the first substrate 2 and the second substrate 3, with the getter box 4.

The exhaust tube 5 is jointed with the top surface of the getter box 4 by welding. The hole which communicates with the exhaust tube 5 with the getter box 4 is formed in the top surface of the getter box 4.

The getter 7 in the getter box 4 is an evaporation type getter of Ba—Al alloy contained in a ring-shaped metal member. The Ba—Al alloy is evaporated onto the internal wall surface of the getter box 4 by radio-frequency induction-heating the ring-shaped member externally. The glittering evaporated film is called a getter mirror.

The getter mirror is formed by the following steps. First, the vacuum hermetic vessel 1 is prepared by aligning the first substrate 2 on which field emission cathodes are formed with the second substrate 3 on which anodes coated with fluorescence are formed and then hermetically sealing them with the sealing compound 8. Next, outgassing is performed while the vacuum hermetic vessel 1 is evacuated. Then the exhaust tube 5 is sealed. Finally, the getter 7 is evaporated.

The exhaust tube 5 is sealed while being thermally melted. In the method of exhausting and sealing the exhaust tube 5, the portion for exhaust is thicker than the display portion formed of the first substrate 2 and the second substrate 3.

Figure 5:
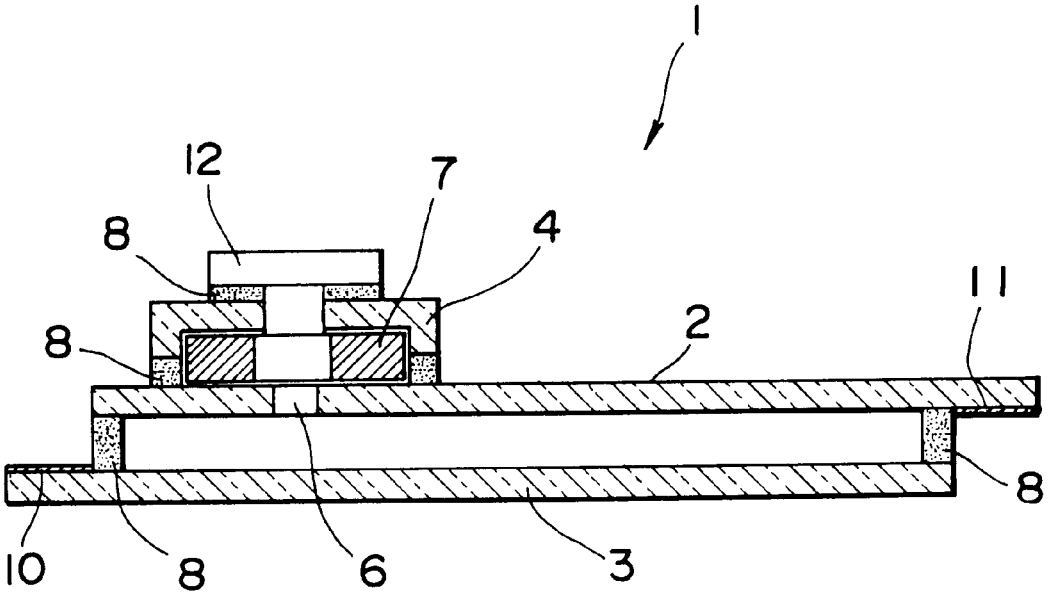
FIG. 5 is a cross-sectional view showing a vacuum hermetic vessel fabricated according to another embodiment of the manufacturing method of the present invention.
Figure 6A:
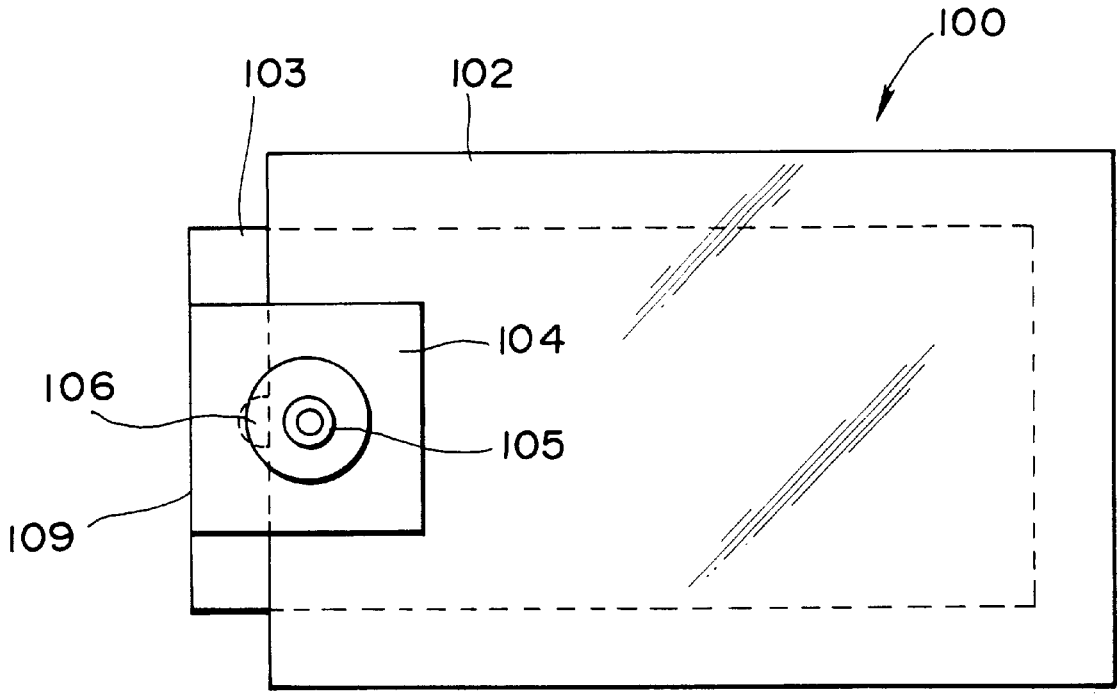
FIG.6(a) (PRIOR ART)
FIG. 6(*a*) is a plan view showing a configuration of a vacuum hermetic vessel fabricated according to a conventional vacuum hermetic vessel manufacturing method.
Figure 6B:
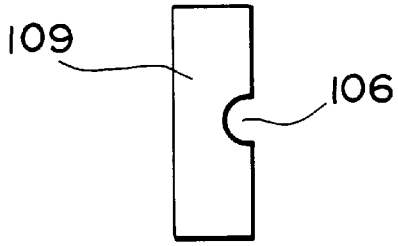
FIG.6(b) (PRIOR ART)

FIG. 5 shows another embodiment of the vacuum hermetic vessel employing the exhausting and sealing structure which can thin the exhaust portion.

In the vacuum hermetic vessel 1 shown in FIG. 5, an exhaust cover 12 is mounted in place of the exhaust tube 5 shown in FIG. 4. Here, duplicate explanations are omitted, but only different structural portions will be explained.

In the vacuum hermetic vessel 1 shown In FIG. 5, a special exhaust tube is pressed against the areas about the exhaust hole formed on the top surface of the getter box 4 while the vacuum hermetic vessel 1 is evacuated. Next, the exhaust cover 12 contained in the exhaust tube is heated while it covers the exhaust hole formed on the top surface of the getter box 4. Thus, the exhaust cover 12 is sealed on the top surface of the getter box 4 using the sealing compound 8.

Such an exhausting and sealing method can eliminate the exhaust tube 5, thus thinning the vacuum hermetic vessel 1. This method is applicable to various electronic equipment.

If non-evaporation type thin film getter is placed between the first substrate 2 and the second substrate 3, instead of the ring-shaped evaporation getter, the getter box 4 can be removed so that the vacuum hermetic vessel 1 can be further thinned.

As described above, the present invention can provide the method of manufacturing plural vacuum hermetic vessels in a batch process, thus mass-producing vacuum hermetic vessels.

According to the vacuum hermetic vessel manufacturing method of the present invention, since the main substrate is cut at least after the sealing step, field emission cathodes or anodes formed on a substrate are not contaminated by particles in the cutting step. As a result, the risks in handling the main (multi-piece separable) substrate can be avoided.

Moreover, since no clean environments are required after the step of superposing main (multi-piece separable) substrates, the production facility expenses can be reduced.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

While a preferred embodiment of the invention has been described with a certain degree of particularity with reference to the drawings, obvious modifications and variations are possible in light of the above teachings. It is therefore to be understood that within the scope of the appended claims. The invention may be practiced otherwise than as specifically described.

What is claimed is:

1. A method of manufacturing a vacuum vessel comprising the steps of:

forming plural exhaust holes in a first main substrate at predetermined positions thereon, said first main substrate from which plural first substrates can be obtained;

superposing a second main substrate over said first main substrate with said plural exhaust holes formed therein, said second substrate from which plural substrates are obtained, and placing plural getter boxes on said first main substrate so as to cover said exhaust tubes formed therein;

hermetically sealing said first main substrate and said second main substrate superposed and, at the same time, hermetically sealing said getter boxes and said first main substrate placed together;

evacuating spaces between said first substrates and said second substrates using said plural getter boxes sealed with said first main substrate, and then sealing said plural getter boxes; and cutting said first main substrate and said second main substrate evacuated and hermetically sealed, at predetermined positions, while lead-out electrodes formed on each of said first substrates and lead-out electrodes formed on each of said second substrates are not covered by another substrates, whereby plural hermetic vessels each formed of a first substrate and a second substrate evacuated and sealed together are obtained at the same time.

2. The method of manufacturing a vacuum vessel as defined in claim 1, further comprising the steps of forming field emission cathodes to each of said first substrates; and forming anodes on which a fluorescent substance is applied, onto each of said second substrates.

3. The method of manufacturing a vacuum vessel as defined in claim 1 wherein said plural getter boxes do not touch an outside edge of said first substrates.

* * * * *

UNITED STATES PATENT AND TRADEMARK OFFICE

CERTIFICATE OF CORRECTION

PATENT NO. : 6,039,620

DATED : March 21, 2000

INVENTOR(S): Shigeo ITOH et al.

It is certified that an error appears in the above-identified patent and that said Letters Patent is hereby corrected as shown below:

On the title page, item [30], the Foreign Application Priority Data has been omitted. It should be:

--[30] Foreign Application Priority Data

Jul. 4, 1996 [JP] Japan.....8-192714--

Signed and Sealed this

Tenth Day of April, 2001

*Attest:*

Nicholas P. Godici

NICHOLAS P. GODICI

*Attesting Officer*

*Acting Director of the United States Patent and Trademark Office*